United States Patent [19]

Jenkins et al.

[11] Patent Number: 4,938,479

[45] Date of Patent: Jul. 3, 1990

[54] TENNIS BALL RETURN APPARATUS

[76] Inventors: Craig D. Jenkins, 8789 W. Cornell Ave. Unit 10-6, Lakewood, Colo. 80227; Scott E. Jenkins, 658 S. Reed Ct., Apt. NH12, Lakewood, Colo. 80226; Jerold D. Jenkins, 850 Vindicator Dr., Suite 212, El Paso, Colo. 80918

[21] Appl. No.: 217,691

[22] Filed: Jul. 11, 1988

[51] Int. Cl.[5] ..... A63B 69/40

[52] U.S. Cl. ..... 273/29 A

[58] Field of Search ..... 273/29 R, 26 D, 29 A, 273/29 BD

[56] References Cited

U.S. PATENT DOCUMENTS

| | | | |
|---|---|---|---|
| 4,203,413 | 5/1980 | Hodges | 273/29 A |
| 4,243,221 | 1/1981 | Godinho | 273/29 BD |
| 4,456,252 | 6/1984 | Hartland | 273/29 A |
| 4,568,089 | 2/1986 | Jenkins et al. | 273/29 B |
| 4,621,812 | 11/1986 | Salanslay | 273/29 A |

FOREIGN PATENT DOCUMENTS

| | | | |
|---|---|---|---|
| 18769 | of 1888 | United Kingdom | 273/29 R |

*Primary Examiner*—T. Brown

*Attorney, Agent, or Firm*—Fleit, Jacobson, Cohn, Price, Holman & Stern

[57] ABSTRACT

A tennis ball return apparatus associated with a tennis net which has its lower edge disconnected from supporting posts to enable balls striking the net to drop substantially straight downwardly rather than rebounding from the net with the apparatus of this invention causing the tennis balls which strike the net and drop downwardly to enter a channel-shaped area having a horizontal tray or trough in the bottom thereof which has a driven endless cord with knots thereon for returning the balls to a putter-type mechanism to project the balls back towards the base line of a tennis court.

15 Claims, 2 Drawing Sheets

TENNIS BALL RETURN APPARATUS

BACKGROUND OF THE INVENTION

1. Field of the Invention

The present invention generally relates to a tennis ball return apparatus associated with a tennis net which has its lower edge disconnected from supporting posts to enable balls striking the net to drop substantially straight downwardly rather than rebounding from the net with the apparatus of this invention causing the tennis balls which strike the net and drop downwardly to enter a channel-shaped area having a horizontal tray or trough in the bottom thereof which has a driven endless cord with knots thereon for returning the balls to a putter-type mechanism to project the balls back towards the base line of a tennis court.

INFORMATION DISCLOSURE STATEMENT

The invention disclosed in this application is an improvement on that disclosed in Pat. No. 4,568,089 issued Feb. 4, 1986 and the prior art of record in that patent is incorporated herein by reference thereto. In addition, prior U.S. Pat. Nos. 1,343,308 issued Nov. 5, 1912 and 3,037,776 issued June 5, 1962 relate to this subject matter. While ball return apparatuses of various types are known, the prior art does not disclose the specific arrangement of the present invention.

SUMMARY OF THE INVENTION

An object of the present invention is to provide a tennis ball return apparatus which includes a horizontal tray along the bottom edge of a tennis net with a driven knotted cord extending along the interior of the bottom of the tray to return tennis balls to a putter which projects the tennis balls toward the base line or serve area of a tennis court to facilitate retrieval of tennis balls by persons playing tennis.

Another object of the invention is to provide a tennis ball return apparatus in accordance with the preceding object in which the tray forms the bottom of a channel-shaped recess having a laterally and upwardly inclined tennis ball engaging and guiding surface on opposite sides of the lower edge of a free hanging tennis net.

Another object of the invention is to provide a tennis ball return apparatus in accordance with the preceding objects in which the tray and channel-shaped recess are aligned with and positioned below the net with the net having a loose lower edge to cause the balls which strike the net to drop substantially straight downwardly for return by the ball return apparatus.

Yet another object of the invention is to provide a tennis ball return apparatus in accordance with the preceding objects in which the structure and function of the device is relatively simple as compared to other ball return mechanisms with the structure being relatively easy to install, operate and maintain.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
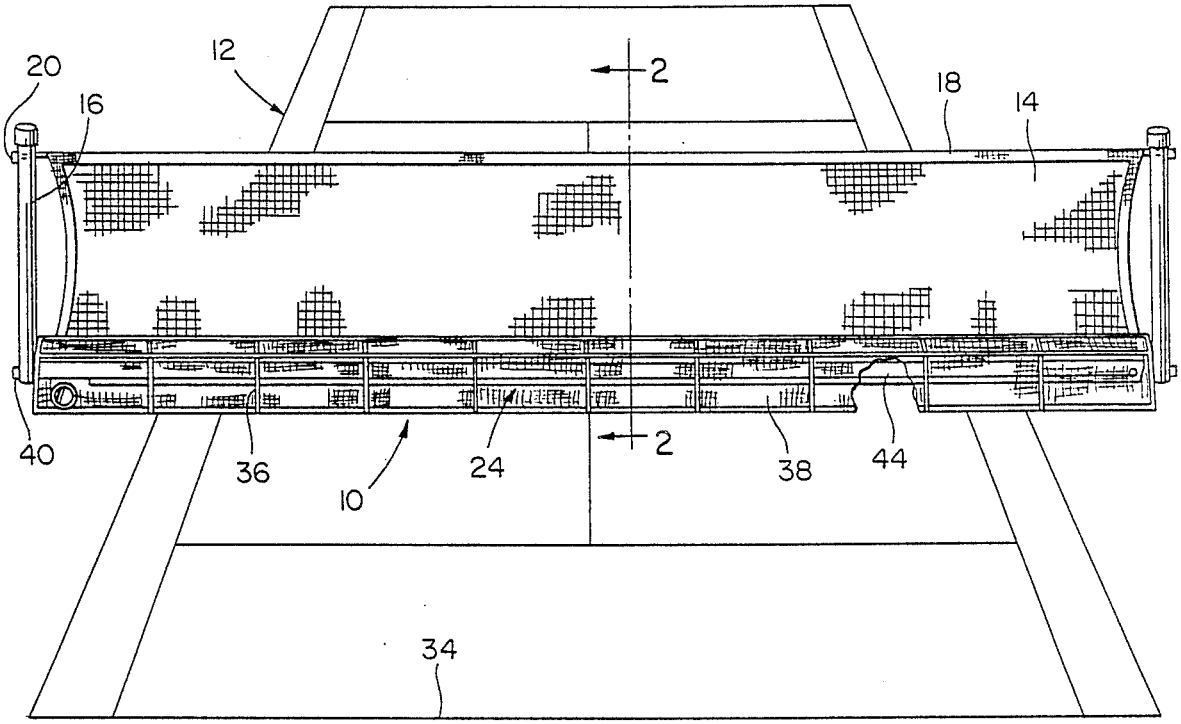
FIG. 1 is a perspective view of the tennis ball return apparatus of the present invention.

The tennis ball return apparatus of the present invention is generally designated by the numeral 10 and is illustrated in association with a conventional tennis court 12 having the usual markings and a tennis net 14 supported between upstanding support posts 16 along each side of the tennis court at the center thereof with the net having a peripheral edge 18 with the top edge thereof being secured to the posts 16 in a conventional manner at 20 but the bottom edge of the net 14 is not attached to the posts or if a conventional net exists on the posts, the bottom edge thereof will be disconnected from the posts so that the net will be free hanging and suspended from the top edge thereof. The bottom edge of the net 14 is folded or rolled up at 21 to a desired height and provided with a plastic covering 22 that is snapped onto the bottom edge of the net to retain it folded and provide a weight thereto so that the net will absorb the impact of a tennis ball coming into contact therewith without moving a substantial distance away from its vertical position so that tennis balls which impact against the net will be stopped and fall substantially vertically downwardly. This structure also maintains the net generally in vertical position even during windy conditions.

Figure 2:
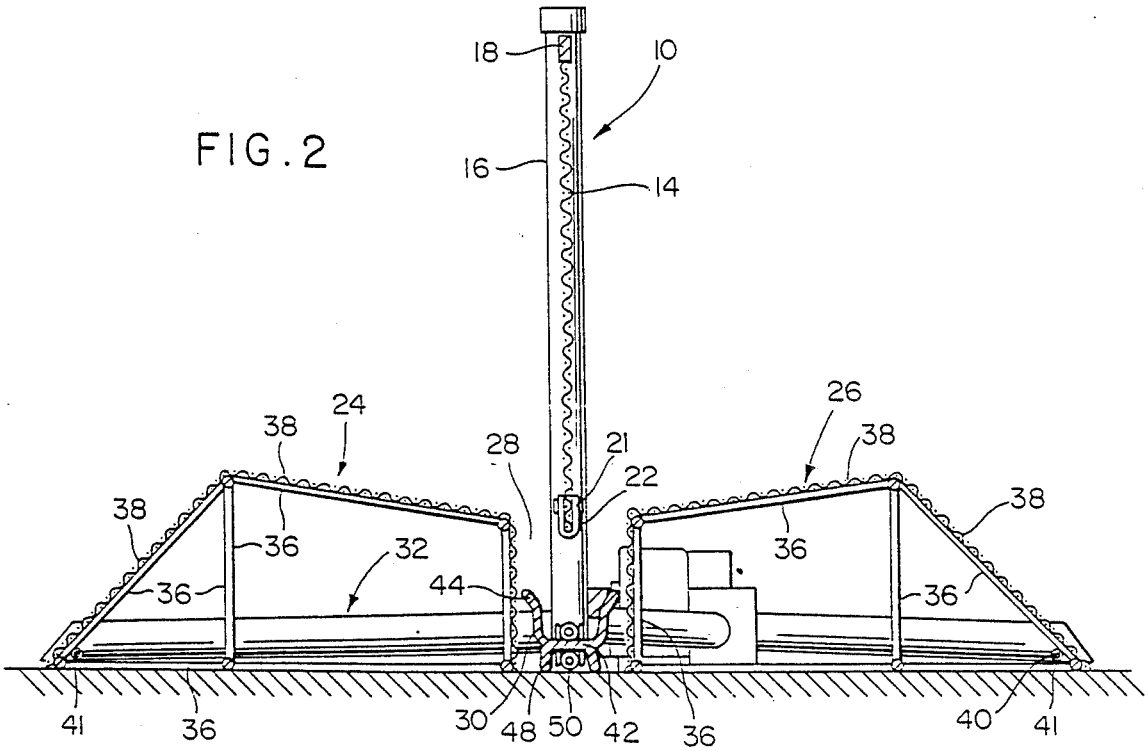
FIG. 2 is a vertical sectional view, on an enlarged scale, taken substantially upon a plane passing along section line 2—2 on FIG. 1 illustrating the specific structure of the return apparatus.

As illustrated in FIG. 2, the lower edge of the net is associated with guide arrangements 24 and 26 on opposite sides of the net which are identical and which define a channel-shaped recess 28 underlying and receiving the lower edge cover 22 on the net 14 so that balls that drop downwardly will ultimately be guided into the channel-shaped recess 28. While the drawings illustrate the present invention incorporated into a tennis court, it may also be supported adjacent a fence at the back of a tennis court, building wall or the like for practice purposes so that a single player can utilize the device and have the balls returned to a serving area. The recess 28 includes a horizontal tray 30 in the bottom thereof which communicates with a tennis ball return putter 32 located below the net 14 for returning tennis balls toward the base line 34 on the tennis court.

Each of the guide arrangements 24 and 26 includes a frame 36 with a net 38 positioned along the exterior thereof. The frame is generally trapezoidal in cross-sectional configuration to provide a downwardly sloping surface to the net 38 extending laterally from each side of the tennis net 14 so that a relatively wide lateral surface that slants downwardly and toward the recess 28 is provided so that when tennis balls drop downwardly from the net 14, they will come into contact with the inclined surfaces of net 38 and roll into the recess 28 and into the tray 30. The frames 36 are stabilized in position by tension cords 40 connected to the posts 16 although various other structures may be utilized for stabilizing the guide arrangements 24 and 26 in spaced parallel relation to form the recess 28 and provide a space for the tray 30. The tray 30 is horizontally disposed and includes a bottom wall 42 and vertical side walls 44 spaced apart sufficiently to receive a tennis ball 46 with the diameter of the tennis ball being less than the space between the walls 44. The tray 30 is preferably constructed of plastic material of one-piece construction with rounded inner and outer corners and longitudinally continuous supporting flanges 48 on the bottom wall 42 to support the tray 30 from the tennis court surface.

In order to move tennis balls 46 along the tray 30, an endless cord 50 of nylon or similar material has one portion positioned along the upper surface of the bottom wall 42 and another portion underlying the bottom wall 42 between flanges 48. The cord 50 has a plurality of longitudinally spaced knots 52 formed therein which define enlarged areas on the cord to facilitate movement of tennis balls. The cord 50 is entrained over end pulleys 54 with one end pulley being driven from a drive wheel 58 which is driven by a motor unit 60 which may include an electric motor powered from a battery or by connection with a 110 volt source of electrical energy. The drive wheel 58 may frictionally drive a support shaft 62 for pulley 54 or a positive gear drive connection may be provided. As the tennis balls 46 reach the end portion of the tray 30, they enter a guide channel or tube 64 which directs them into the tennis ball return putter 32. The return putter 32 may be located at either end of tray 30 or can be located in the central portion of the tray 30 with two cords being used to move tennis balls toward the center of the tray for entry into the return putter 32 and may be constructed in accordance with that disclosed in Patent No. 4,568,089 or the putter may be as shown in FIGS. 4 and 5.

Figure 4:
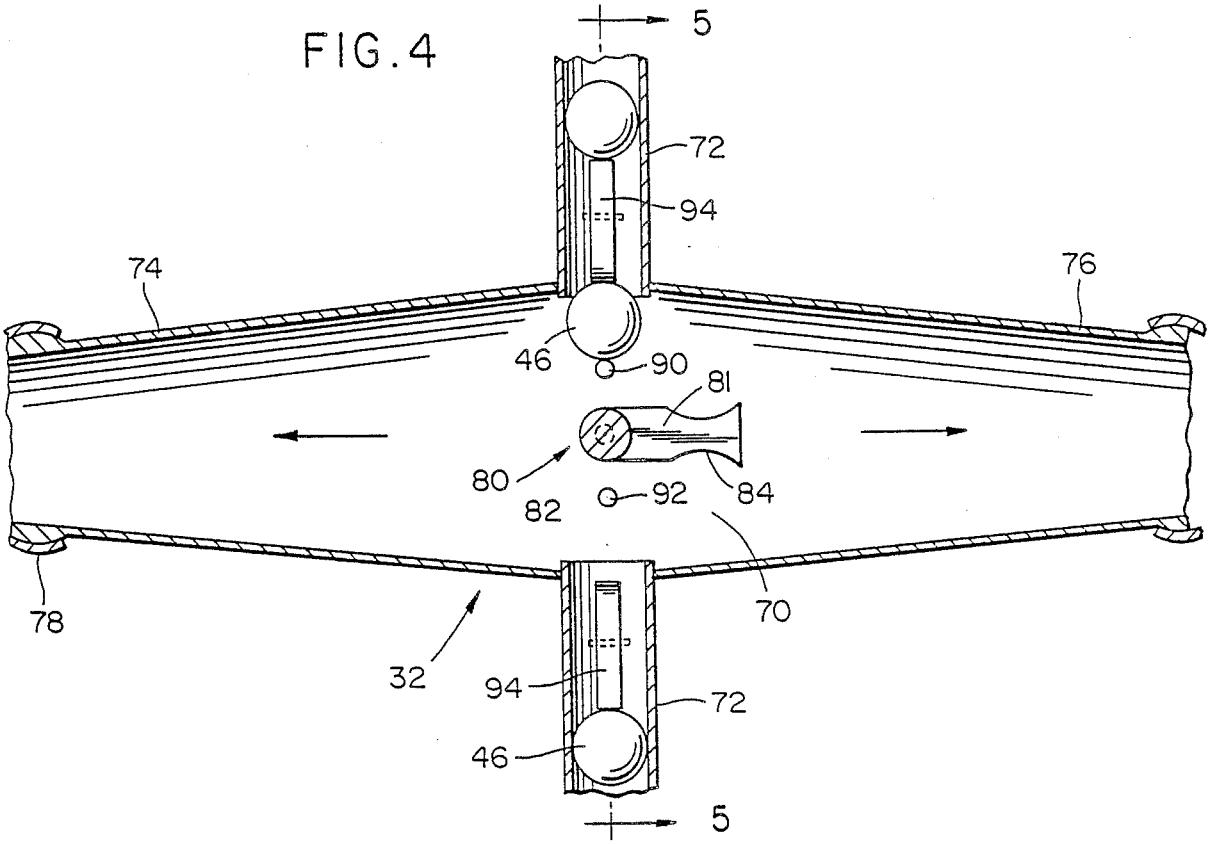
FIG. 4 is a plan view, with the top removed, of the tennis ball return device.
Figure 5:
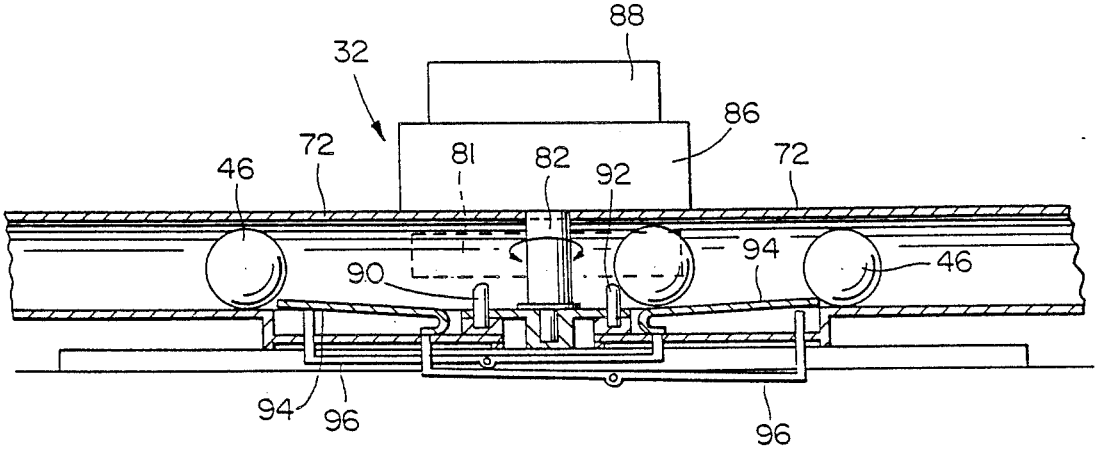
FIG. 5 is a sectional view taken generally along section line 5—5 on FIG. 4.
Figure 3:
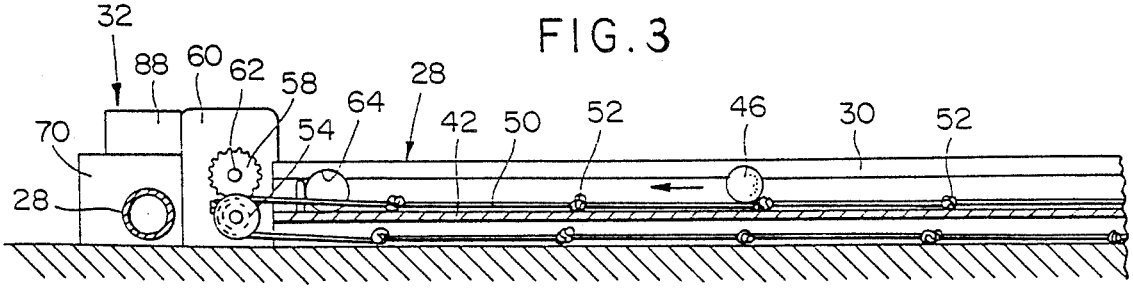
FIG. 3 is a sectional view of the trough with the endless cord to move tennis balls to the ball return device.

The putter 32 as illustrated in FIGS. 3 and 4 includes a hollow central structure 70 having a single or two opposed inlet tubes 72 receiving tennis balls 46 from the tray 30 through a tube 64 or tubes 64 depending on whether the ball return putter is at the end or center of the net. The balls 46 are discharged in selected direction through a tubular guide 74 or 76 toward one of the base lines 34. Each of the tubular guides includes an adjustable end tube 78 at the outer end to direct the tennis balls 46 toward the desired area of the base line 34 in a manner somewhat similar to the structure illustrated in Patent No. 4,568,089. Positioned centrally in the hollow area 70 is a putter 80 in the form of an arm mounted on a shaft 82 with opposite sides of the putter arm 81 having concave recesses 84 to engage a tennis ball 46 entering the central area from one of the tubes 72. Positioned above the top wall of the hollow central area 70 is a bidirectional motor 86 connected with the shaft 82 to move the putter 80 in a selected rotational direction and positioned above the motor 86 is a rechargeable power pack 88 which may be utilized in areas that do not have a source of electricity available. The motor 86 includes a control module to enable operation of the motor 86 in a manner described hereinafter.

The hollow area 70 includes a pair of stop pins or pegs 90 and 92 which limit inward rolling movement of tennis balls 46 from the tubes 72 with the pins or pegs 90 and 92 being sufficient in height to limit the inward movement of the balls but also sufficiently short to enable the putter arm 81 to pass above the upper ends of the pegs so that the putter can engage the tennis balls. Thus, the pegs serve as a stop for the balls to position them in the hollow central area and prevent them from rolling freely into the hollow central area. A control structure is provided for each of the tubes 72 to control movement of tennis balls into the hollow central area 70. This structure includes a lever or fulcrum member 94 in each tube 72. If the tennis ball in left tube 72 is first to approach the hollow central area 70, it will roll onto the outer end of the lever 94 which is normally in a downward position and as it rolls onto the inner end of the lever 94, the inner end of the lever 94 will be pushed downwardly thus preventing another ball from rolling down the left tube 72 since the outer end of the lever will then block such a ball. At the same time when the inner end of the lever 94 is moved downwardly, it will actuate a lever 96 or an electronic switch which will force the outer end of the lever 94 on the right tube 72 to an upward position thus preventing a ball from entering the putting position in the hollow central area 70 until the ball that has entered the putting position from left tube 72 has been putted by movement of the putter 80. This same action will occur on both sides of the hollow area so that only one ball will enter the putting area at a given time. The putter 80 may be operated by a voice actuated switch assembly and circuitry contained in the module with the motor with this structure being capable of activating the putter and distinguishing from which side of the tennis court the voice originates so that the players will have control over which player receives the ball projected from the ball return device. Alternatively, individual switches at the base lines may be used to control the return putter and cord drive arrangement. The entire assembly will be positioned in a waterproof cover for longevity. This structure enables balls to be sequentially and selectively returned to either base line of the tennis court as controlled by the voice activation of the players with the lever interlocking control system providing for only a single tennis ball to be in the putting position at any given time with the tennis balls being returned to the center through the tube or tubes 72 from tray 30.

In this construction, the original tennis net is utilized and the bottom is untied. To provide adequate room for the return mechanism, the bottom edge of the net may be folded upwardly so that it obtains a specific height for absorbing the impact of the tennis balls. To obtain the correct height and weight, the original net is folded or rolled up from the bottom and the plastic snap-on cover 22 is attached. Now, when a ball makes contact with the net, it may move the plastic cover 22 to some degree and the plastic cover will drag on the top of the frame 36 and net 38 on the structures 24 or 26. This action helps to stop the balls and causes the balls to roll into the recess 28 and onto the tray 30. The cable or cord 40 looped around the tennis posts 14 passes through eyelets 41 located at the bottom outer corner of the structures 24 and 26 with the cable or cord being tightened to retain the entire structure in its correct position. As indicated previously, the return apparatus can be placed at the back of a tennis court and supported adjacent a fence or the like to enable a single player to effectively practice with the balls being returned to the central portion of the base line and, with this arrangement, the device will return balls that are hit into the back of the court such as against a fence or the like.

The foregoing is considered as illustrative only of the principles of the invention. Further since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A tennis ball return apparatus comprising a pair of ball guide arrangements adapted to be oriented along opposite sides of a bottom portion of a tennis net and spaced apart to define a ball receiving recess therebetween, a tray in the bottom of the recess for receiving and guiding balls to a location for return to the base line of a tennis court, each of said guide arrangements including a frame and inclined net having an upwardly facing surface of substantial lateral extend with the inclined net being inclined downwardly toward the recess.

2. The structure as defined in claim 1 wherein said tray is horizontally positioned in the recess and an endless flexible member having a portion supported for movement in relation to the upper surface of the tray, said flexible member including means for engaging tennis balls on the tray and moving them to said return location.

3. The structure as defined in claim 2 wherein a return putter is located at said return location and communicating with said tray for receiving balls therefrom and projecting them toward the base line of a tennis court.

4. The structure as defined in claim 2 wherein each of said frames includes an outer inclined net forming a lateral extension of said inclined net which inclines downwardly toward the recess, said outer inclined net being inclined downwardly in a direction away from the recess.

5. The structure as defined in claim 1 wherein each of said frames includes an outer inclined net forming a lateral extension of said inclined net which inclines downwardly toward the recess, said outer inclined net being inclined downwardly in a direction away from the recess.

6. A ball return apparatus comprising an elongated net, means supporting the ends of said net with the net oriented in generally vertical position in the flight path of a ball, said vertical net including generally parallel upper and lower horizontal edges with said supporting means engaging only the ends of the upper edge of the net with the lower edge being freely suspended, means defining a ball receiving recess in adjacent underlying relation to the entire lower edge of the net, means defining an upwardly and outwardly inclined surface extending from at least one edge of said recess whereby balls striking the net will be stopped and drop downwardly into the recess or onto the inclined surface for rolling into said recess, and means receiving balls from said recess and returning them to a desired location, said means defining an inclined surface extending from both edges of said recess and including a framework with an inclined net covering the upper surface thereof, and means connecting the framework to said supporting means for stabilizing said inclined surfaces, the lower edge of said vertical net including a cover strip engageable with the edges of the recess and inclined surfaces when swung laterally by a ball impacting against the vertical net to retard and stop the ball so that it will drop downwardly onto the inclined surfaces or into the recess.

7. The structure as defined in claim 6 wherein said recess includes a tray forming the bottom thereof and terminating at the ball return means, and means moving balls along the upper surface of the tray to said ball return means.

8. The structure as defined in claim 7 wherein said ball moving means comprises an endless flexible member entrained over pulley means at the opposite ends of the tray with one portion of the flexible member between the pulley means being positioned along the upper surface of the tray, projecting means on said flexible member to engage balls on the tray, and means driving said flexible member.

9. The structure as defined in claim 8 wherein said flexible member is a cord and said projecting means is a plurality of longitudinally spaced knots formed in the cord.

10. The structure as defined in claim 9 wherein said ball return means includes a putter receiving balls from the tray, said putter including a pivotal arm engageable with a ball and projecting it in a desired direction.

11. The structure as defined in claim 10 wherein said putter includes means permitting entry of single balls into the putter in sequence.

12. In combination with a generally vertical tennis net extending transversely of a tennis court, a tennis ball return apparatus positioned transversely of the tennis court in underlying relation to a bottom edge of said tennis net, said ball return apparatus comprising means defining a ball receiving recess in underlying alignment with the bottom edge of the tennis net and positioned to receive the lower edge of the tennis net in an upper portion of the recess, and means defining upwardly facing inclined surfaces extending laterally from at least one edge of said recess, said means defining upwardly facing inclined surfaces including an outwardly and upwardly inclined inner surface having its lower edge connected with an edge of said recess and its higher edge remote from the recess and an outwardly and downwardly inclined outer surface having its higher edge connected to the higher edge of the inclined inner surface and the lower edge oriented adjacent the surface of the tennis court.

13. The combination as defined in claim 12 wherein said recess includes a generally horizontally disposed tray positioned therein for receiving balls dropping downwardly from the net into the recess or rolling down the inclined inner surface into the recess, and means moving balls positioned on the tray along the top surface thereof to a discharge point and means receiving balls from the tray and discharging them toward a base line of the tennis court.

14. The combination as defined in claim 12 wherein the lower edge of the tennis net is suspended freely from the top edge thereof and includes an upwardly folded lower portion that will contact an edge of the recess and drag along the inclined inner surface for absorbing the impact of tennis balls against the tennis net and causing balls impacting against the tennis net to drop into the recess or onto one of the inclined inner surfaces.

15. The combination as defined in claim 12 wherein said means defining upwardly facing inclined surfaces is replicated on each side of said recess.

* * * * *